US008666273B2

(12) United States Patent
Tanaka

(10) Patent No.: US 8,666,273 B2
(45) Date of Patent: Mar. 4, 2014

(54) IMAGE HEATING DEVICE

(75) Inventor: Masanobu Tanaka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 205 days.

(21) Appl. No.: 13/279,736

(22) Filed: Oct. 24, 2011

(65) Prior Publication Data

US 2012/0099882 A1 Apr. 26, 2012

(30) Foreign Application Priority Data

Oct. 26, 2010 (JP) ..... 2010-239606

(51) Int. Cl.
*G03G 15/20* (2006.01)

(52) U.S. Cl.
USPC ..... 399/69; 399/328

(58) Field of Classification Search
USPC ..... 399/38, 67–70, 320, 328, 329
See application file for complete search history.

(56) References Cited

U.S. PATENT DOCUMENTS 7,650,105 B2 1/2010 Ogawa et al.
7,653,322 B2 * 1/2010 Maeda et al. ..... 399/69
8,295,726 B2 * 10/2012 Kagawa et al. ..... 399/69
8,295,750 B2 * 10/2012 Yamana ..... 399/328
2010/0135706 A1 6/2010 Miki et al.
2011/0236084 A1 9/2011 Nishida et al.
2011/0305474 A1 12/2011 Tanaka et al.
2012/0155938 A1 6/2012 Tanaka et al.

FOREIGN PATENT DOCUMENTS

JP 2004-198659 A 7/2004
JP 2008-152139 A 7/2008

* cited by examiner

*Primary Examiner* — Hoan Tran
(74) *Attorney, Agent, or Firm* — Fitzpatrick, Cella, Harper & Scinto

(57) ABSTRACT

An image heating device includes a rotatable member, an opposing member for forming a nip, between itself and the rotatable member, in which recording paper on which an image is carried is to be nip conveyed and heated, and a heater contacting the rotatable member's outer surface and including a belt, a first roller stretching the belt at an upstream side of the rotatable member with respect to a rotational direction of the rotatable member, a second roller downstream of the first roller, and first and second heating portions for heating the first and second rollers to first and second target temperatures, respectively. The device also includes a heating control portion for controlling the heater, and a portion for executing an operation in a control mode in which the second target temperature is set so as to be lower than the first target temperature.

4 Claims, 5 Drawing Sheets

IMAGE HEATING DEVICE

FIELD OF THE INVENTION AND RELATED ART

The present invention relates to an image heating device, used in an image forming apparatus such as a copying machine or a printer. As the image heating device, e.g., a fixing device for heat-fixing an unfixed image, formed on recording paper, as a fixed image and a glossiness increasing device for increasing glossiness of an image fixed on the recording paper by heating the image can be used. Particularly, the image heating device is suitable for the image forming apparatus, such as the copying machine or the printer (e.g., a laser printer or an LED printer), in which an electrophotographic-type process is employed and an image is formed on the recording paper as a recording material by using an image bearing member.

In a conventional image forming apparatus, the latent image is formed at an image forming portion by using light, magnetism, electric charge or the like, and then the latent image is developed to form a visible image. Then, the visible image is transferred onto recording paper, conveyed to the image forming portion by a transfer-material conveying means, by using an electrostatic force and the transferred visible image is fixed on the recording paper by heat in a fixing device to obtain an image on the recording paper. Specifically, in a color image forming apparatus of an electrophotographic type, the latent image of every color is formed on a photosensitive drum, which is an image bearing member. The resultant latent images are developed into developer images by a plurality of developing devices. Then, the developer images are intermediary-transferred successively onto an intermediary transfer belt as an endless belt held by a transfer device to obtain color images. Thereafter, the color images are collectively transferred onto the recording paper (recording material) to obtain a desired color image. In this type of apparatus, the conveying path of the recording paper is similar to that in the case of a single developer image, so that the number of types of the recording paper compatible with this type of apparatus is large and there are many techniques which can be commonly applicable in terms of mechanisms. Therefore, it is possible to easily realize downsizing and price-reduction of the apparatus.

As the conventional fixing device used in the electrophotographic image forming apparatus such as the copying machine or the printer, the following constitution has been frequently used in general. Specifically, the constitution is employed in which a fixing roller and a pressing roller are press-contacted to each other and the fixing roller is heated to a predetermined temperature (fixing temperature) by a heating means, such as a halogen heater (e.g., a halogen lamp), disposed inside the fixing roller or both of the fixing roller and the pressing roller.

Further, it is also possible to employ the constitution in which recording paper on which an unfixed toner image is formed is, after heating, passed through a press-contact portion (fixing nip) between the fixing roller and the pressing roller to perform fixing of the toner image by heat and pressure (a constitution using a heating-roller fixing type of apparatus).

Particularly, in the fixing device for color image formation, the constitution using an elastic roller, as the fixing roller, is generally employed in which an elastic layer of a silicone rubber or the like is used as a surface layer. By using the elastic roller as the fixing roller, the surface of the fixing roller is elastically deformed correspondingly to an uneven portion of the unfixed toner image to contact the recording paper so as to cover the toner-image surface. For that reason, it becomes possible to satisfactorily perform heat fixing with respect to even the unfixed color toner image, which uses a larger toner amount than that of the unfixed monochromatic toner image.

At the same time, by a distortion-releasing effect of the elastic layer in the fixing nip, it is possible to improve a parting property of the color toner, which is liable to cause offset compared with the monochromatic toner. Further, a nip shape in the fixing nip is convex upward (toward the fixing roller side) (so-called, a reverse nip shape), so that the parting performance of a sheet (recording paper) is improved to permit separation of the sheet without using a separating means, such as a separating claw (self-stripping), and thus image deterioration due to the use of the separating means can be eliminated. Incidentally, in the image forming apparatus using the monochromatic toner, a constitution is employed in which the elastic layer is not provided to the fixing roller, but is provided only to the pressing roller to ensure the fixing nip.

Incidentally, the fixing roller or pressing roller in which the elastic layer is provided is very low in thermo-conductivity of the elastic layer. For that reason, in the case where the heating means is provided inside the roller, there arises a problem that the warm-up time is increased and that the temperature of the fixing roller is lowered during continuous sheet passing at high speed.

In order to solve such a problem, a constitution has been used and known in which an external heating means contacts the surface of the fixing roller to externally heat the fixing roller (constitution of an externally heat-fixing type. For example, in Japanese Laid-Open Patent Application (JP-A) 2004-198659, a technique using an external heating belt (endless belt) stretched, as the external heating means, by supporting rollers (technique using externally heating belt fixing type) has been disclosed. In this technique, a contact area between the external heating means and the fixing roller is increased by using the external heating belt as the external heating means, so that heat supply from the external heating means to the fixing roller is accelerated.

In the external heating-belt fixing type of apparatus, in order to enhance an external heating performance, the external heating belt contacting the fixing roller is required to be kept at a high temperature. In order to keep the external heating belt at a high temperature, there is a need to increase the contact area between the external heating belt and each of the supporting rollers in which a heat generating element is provided inside thereof and thus the amount of heat conduction (transfer) from the supporting rollers to the external heating belt is increased.

For that reason, in the external heating-belt fixing type of apparatus, the heat generating element may suitably be provided inside each of the plurality of supporting rollers for stretching the external heating belt (JP-A 2004-198659). Further, a heat quantity of each of the heat generating elements provided inside the plurality of supporting rollers is controlled by a temperature control portion on the basis of a detection result of a thermistor contacting an outer surface of a contact portion where the external heating belt contacts the supporting roller. As a result, the surface temperature of the external heating belt is controlled at a predetermined temperature (JP-A 2008-152139).

However, in the fixing device described in JP-A 2008-152139, target temperatures of the contact portions for the respective heat generating elements were the same and therefore the fixing device involved the following problem.

The downstream-side supporting roller is required to heat the belt from which the heat is dissipated to the fixing roller and therefore from the viewpoint of the heating of the belt, a larger heat quantity is provided by the downstream-side supporting roller than that by the upstream-side supporting roller. For this reason, when the target temperature of the downstream-side supporting roller is equal to the target temperature of the upstream-side supporting roller, the following problem occurs. As a result that the heat quantity provided to the downstream-side supporting roller is increased, when the fixing roller is stopped, overshooting from the downstream-side supporting roller is increased, and thus the belt is liable to be damaged at the contact portion between the downstream-side supporting roller and the belt.

SUMMARY OF THE INVENTION

A principal object of the present invention is to provide an image heating device capable of suppressing overheating in a downstream-side supporting roller area of a belt-like external heating means contacting an outer surface of an image heating member.

According to an aspect of the present invention, there is provided an image heating device comprising:

a rotatable member;

an opposing member for forming a nip, between itself and the rotatable member, in which recording paper on which an image is carried is to be nip-conveyed and heated;

external heating means for heating the rotatable member in contact with an outer surface of the rotatable member, wherein the external heating means includes a belt, a first supporting roller for stretching the belt at an upstream side of the rotatable member with respect to a rotational direction of the rotatable member, a second supporting roller provided downstream of the first supporting roller, first heating means for heating the first supporting roller so that a temperature of the first supporting roller is a first target temperature, and second heating means for heating the second supporting roller so that a temperature of the second supporting roller is a second target temperature;

heating control means for controlling the external heating means; and an executing portion for executing an operation in a control mode in which the second target temperature is set so as to be lower than the first target temperature.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

<First Embodiment>

(Image Forming Apparatus)

Figure 2:
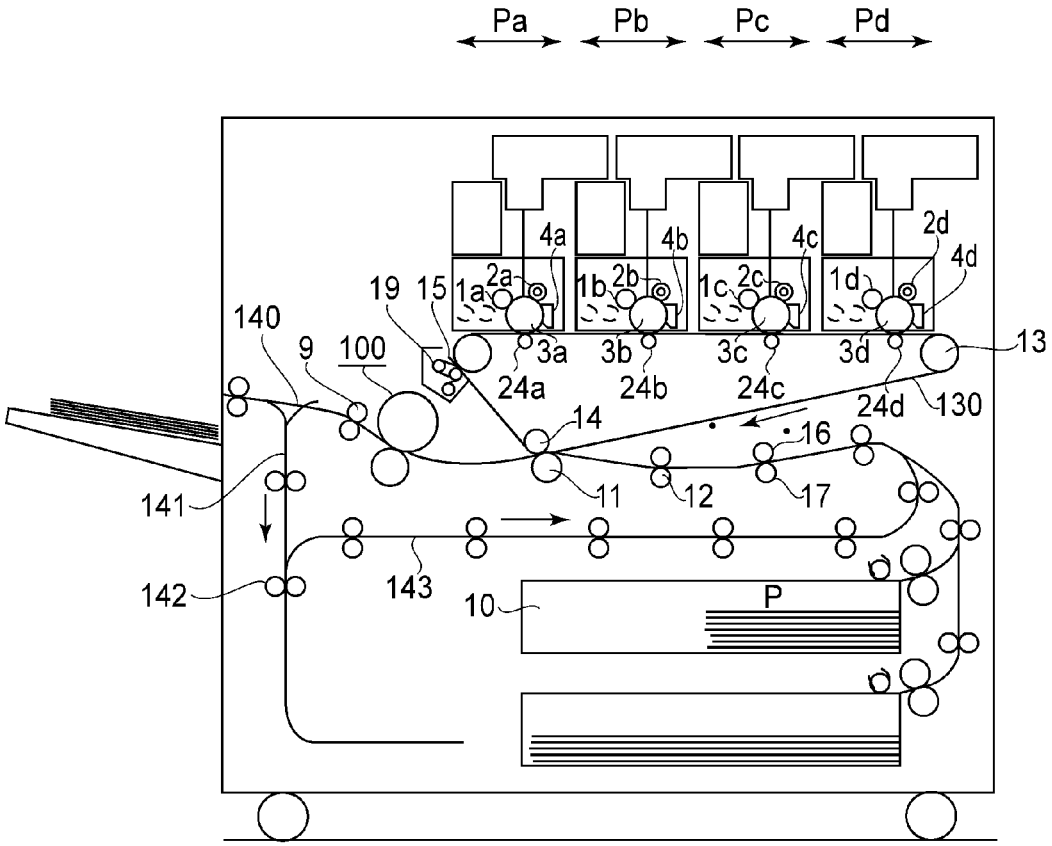
FIG. 2 is a schematic view of an image forming apparatus in which the fixing device according to First Embodiment of the present invention is mounted.

In an image forming apparatus shown in FIG. 2, first to fourth image forming portions Pa, Pb, Pc and Pd are juxtaposed and toner images of different colors (yellow, magenta, cyan and black) are formed through a process including latent-image formation, development and transfer. The image forming portions Pa, Pb, Pc and Pd include dedicated image bearing members, i.e., electrophotosensitive drums 3*a*, 3*b*, 3*c* and 3*d*, respectively, in this embodiment, and on each of the drums 3*a*, 3*b*, 3*c* and 3*d*, an associated color toner image is formed. Adjacently to the respective drums 3*a*, 3*b*, 3*c* and 3*d*, an intermediary transfer member 130 stretched by rollers 13, 14 and 15 is provided. The respective color toner images formed on the drums 3*a*, 3*b*, 3*c* and 3*d* are primary-transferred onto the intermediary transfer member 130 and then are transferred onto recording paper (recording material) P at a secondary transfer portion. Further, the recording paper P on which the toner images are transferred is subjected to fixing the toner images by a fixing device 100 under heat and pressure and thereafter is discharged to the outside of the image forming apparatus as a recording image-formed product.

At the peripheries of the drums 3*a*, 3*b*, 3*c* and 3*d*, drum chargers 2*a*, 2*b*, 2*c* and 2*d*, developing devices 1*a*, 1*b*, 1*c* and 1*d*, primary transfer chargers 24*a*, 24*b*, 24*c* and 24*d* and cleaners 4*a*, 4*b*, 4*c* and 4*d* are provided. Further, at an upper portion in the image forming apparatus, a light source device and a polygon mirror, which are not shown, are provided. Laser light from the light source device is used for scanning the drum surface while rotating the polygon mirror, and then light fluxes of the scanning light are deflected by a reflection mirror and are focused on a generating line of each of the drums 3*a*, 3*b*, 3*c* and 3*d* by an fθ lens, so that the drum surface is exposed to light. Thus, on each of the drums 3*a*, 3*b*, 3*c* and 3*d*, the latent image depending on an image signal is formed.

In the developing devices 1*a*, 1*b*, 1*c* and 1*d*, as developers, yellow toner, magenta toner, cyan toner and black toner, respectively, are filled in a predetermined amount by unshown supplying devices. The developing devices 1*a*, 1*b*, 1*c* and 1*d* develop the latent images on the drums 3*a*, 3*b*, 3*c* and 3*d*, respectively, to visualize the latent images as a yellow toner image, a magenta toner image, a cyan toner image and a black toner image, respectively.

The intermediary transfer member 130 stretched by rollers 13, 14 and 15 is rotationally driven in an arrow direction at the same peripheral speed as those of the drums 3 (3*a*, 3*b*, 3*c*, 3*d*). The yellow toner image for a first color formed and carried on the drum 3*a* is intermediary-transferred onto an outer peripheral surface of the intermediary transfer member 130 by pressure and an electric field generated by a primary transfer bias applied to the intermediary transfer member 130 in a process in which the yellow toner image passes through a nip between the drum 3*a* and the intermediary transfer member 130. Similarly as in the case of the yellow toner image for the first color, a magenta toner image for a second color, a cyan toner image for a third color and a black toner image for a fourth color are successively transferred superposedly onto the intermediary transfer member 130, so that the synthetic color toner image corresponding to an objective color image is formed. A secondary transfer roller 11 is shaft-supported in parallel and correspondingly to the intermediary transfer member 130 and is disposed in contact to a lower surface portion of the intermediary transfer member 130. To the secondary transfer roller 11, a desired secondary transfer bias is applied by a secondary transfer-bias voltage source. A synthetic color toner image obtained by transferring the color toner images onto the intermediary transfer member 130 to be superposed is transferred onto the recording paper P in the following manner. That is, the recording paper P is fed from a sheet feeding cassette 10 and passes through a registration roller 12 via conveying rollers 16 and 17 and the like and passes through a pre-transfer guide to be conveyed into a contact nip between the intermediary transfer member 130 and the secondary transfer roller 11 with predetermined timing and at the same time the secondary transfer bias is applied from the bias voltage source. By this secondary transfer bias, the synthetic color toner image is transferred from the intermediary transfer member 130 onto the recording paper P. The synthetic color toner image is formed while leaving certain margins from four edges of the recording paper P. In this embodiment, a leading end margin is about 2-3 mm.

Transfer residual toners on the drums 3*a*, 3*b*, 3*c* and 3*d* from which the primary transfer is ended are removed from the drums by the cleaners 4*a*, 4*b*, 4*c* and 4*d*, respectively, and then the drums 3*a*, 3*b*, 3*c* and 3*d* prepare for subsequent latent-image formation. Foreign matter, such as toner and the like, which remain on the transfer belt (intermediary transfer member) 130 are wiped with a cleaning web (nonwoven fabric) 19 by bringing the cleaning web 19 into contact to the surface of the transfer belt 130.

The recording paper P subjected to the toner image transfer is successively introduced into the fixing device 100, by which heat and pressure are applied to the recording paper P to fix the toner image on the recording paper P.

In the case of both-side (surface) printing, the recording paper P fed from the sheet feeding cassette 10 is subjected to one-side (surface) fixing by being passed through the registration roller 12, the pre-transfer guide and the contact nip between the intermediary transfer member 130 and the secondary transfer roller 11 and then by being subjected to the fixing by the fixing device 100, and then is introduced into a reverse path 141 by a flapper 140. Thereafter, the recording paper P is reversed by a reversing roller 142 and then is guided into a both-side path 143. Then, the recording paper P passes again the registration roller 12, the pre-transfer guide, and the contact nip between the intermediary transfer member 130 and the secondary transfer roller 11 to be subjected to the transfer on a second surface (the other surface) and is subjected to fixing by the fixing device 100 to complete the both-side fixing. Further, the direction of the flapper 140 is switched during the both-side printing and the recording paper P subjected to the both-side fixing is discharged to the outside of the image forming apparatus as a recording image-formed product.

(Fixing Device)

Figure 1:
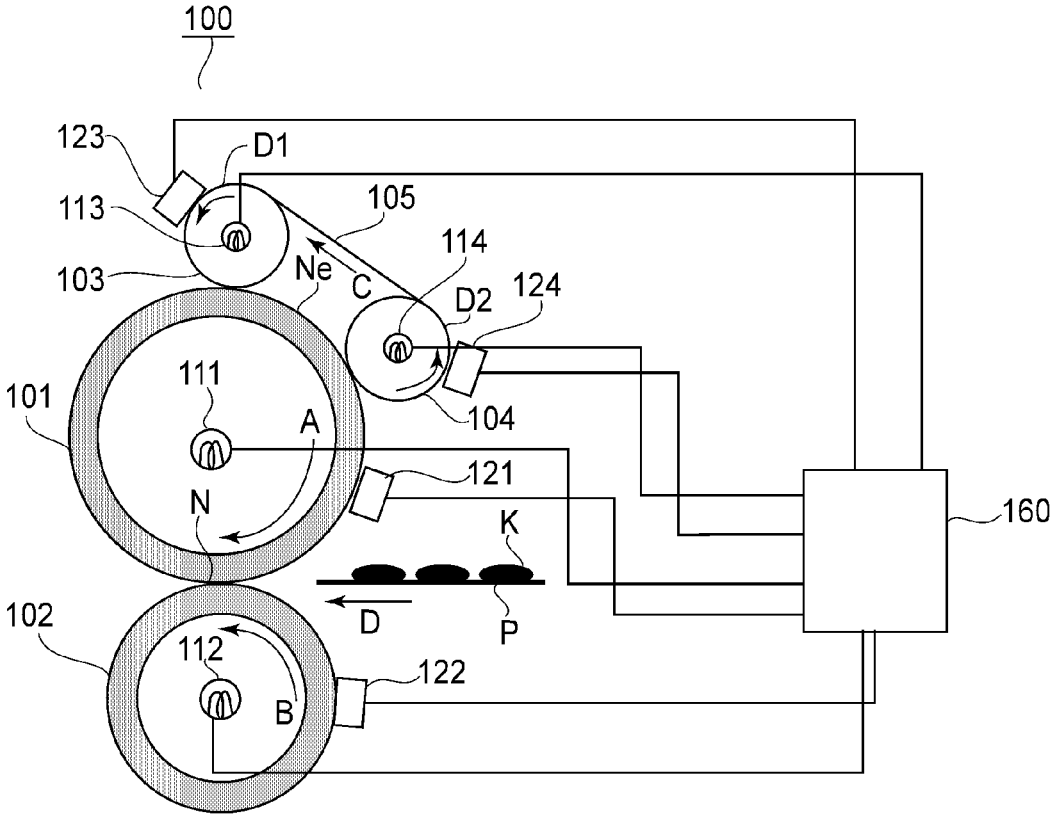
FIG. 1 is a schematic sectional view of a fixing device of an external heating belt type according to First Embodiment of the present invention.

As shown in FIG. 1, the fixing device 100 as the image heating device includes a fixing roller 101 as a fixing member which is a rotatable member, and a pressing roller 102 as a pressing member which is an opposing member. The fixing device further includes an external heating belt 105 stretched by a first supporting roller 103 and a second supporting roller 104. The pressing roller 102 is urged against the fixing roller 101 by an unshown urging means with predetermined pressure, so that a fixing nip N is formed between itself and the fixing roller 101. The pressing roller 102 is rotated in an arrow B direction at a predetermined speed, e.g., at a peripheral speed of 500 mm/sec by the rotation of the fixing roller 101.

An unfixed toner image K carried on the recording paper P is inserted into the fixing nip N in which the toner image K is fixed on the recording paper P. That is, the recording paper P on which the unfixed toner image K is carried is nip-conveyed in the fixing nip N to fix the unfixed toner image K on the recording paper P.

The fixing roller 101 is rotationally driven by an unshown driving source in an arrow A direction at a predetermined speed, e.g., at a peripheral speed of 500 mm/sec. The fixing roller 101 shown in FIG. 3 includes a cylindrical metal core 101*a* (of aluminum in this embodiment) of 74 mm in outer diameter, 6 mm in thickness and 350 mm in length. The metal core 101*a* is coated with a 3 mm-thick heat-resistant elastic layer 101*b* of silicone rubber (JIS-A hardness: 20 degrees) in this embodiment.

The elastic layer 101*b* is coated with a 100 μm-thick heat-resistant parting layer 101*c* of fluorine-containing resin (PFA tube in this embodiment). Inside the metal core 101*a* of the fixing roller 101, a halogen heater 111 with rated power of, e.g., 1200 W is provided as a heat generating element, so that the fixing roller 101 is internally heated so that the surface temperature of the fixing roller 101 is a predetermined temperature.

Figure 3:
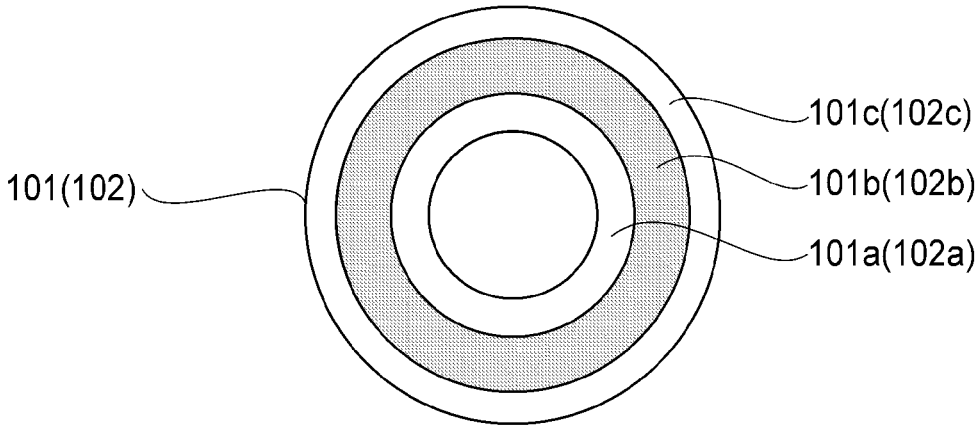
FIG. 3 is a schematic sectional view showing a fixing roller and a pressing roller in First Embodiment.

The surface temperature of the fixing roller 101 is detected by a fixing thermistor 121 as a temperature detecting means contacting the fixing roller 101. Then, on the basis of this detection temperature, a heater control device 160 as a temperature control (adjusting) means turns on and off the halogen heater 111, so that the surface temperature of the fixing roller 101 is controlled at a predetermined target temperature of, e.g., 200° C. The heater control device 160 is an executing portion for setting the target temperature in the present invention. The fixing roller 102 includes, as shown in FIG. 3, a cylindrical metal core 102*a* (of aluminum in this embodiment) of 54 mm in outer diameter, 5 mm in thickness and 350 mm in length. The metal core 102*a* is coated with a 3 mm-thick heat-resistant elastic layer 102*b* of silicone rubber (JIS-A hardness: 15 degrees) in this embodiment.

The elastic layer 102*b* is coated with a 100 μm-thick heat-resistant parting layer 102*c* of fluorine-containing resin (PFA tube in this embodiment). Inside the metal core 102*a* of the pressing roller 102, a halogen heater 112 with rated power of, e.g., 1200 W is provided as a heat generating element, so that the pressing roller 102 is internally heated so that the surface temperature of the pressing roller 102 is a predetermined temperature.

The surface temperature of the pressing roller 102 is detected by a fixing thermistor 122 as a temperature detecting means contacting the pressing roller 102. Then, on the basis of this detection temperature, a heater control means 130 turns on and off the halogen heater 112, so that the surface temperature of the pressing roller 102 is controlled at a predetermined target temperature of, e.g., 130° C.

(External Heating Belt and Belt Conveying System)

The first and second supporting rollers 103 and 104 for stretching the external heating belt 105 are urged toward the fixing roller 101 with predetermined pressure, so that the external heating belt 105 and the fixing roller 101 form an external nip Ne therebetween. The external heating belt 105 is rotated in an arrow C direction at a predetermined speed, e.g., at a peripheral speed of 500 mm/sec by the rotation of the fixing roller 101. As a result, the external heating belt 105 which is rotatably stretched by the plurality of supporting rollers and contacts the outer surface of the fixing roller 101 which is a rotatable member heats the fixing roller 101.

Figure 4:
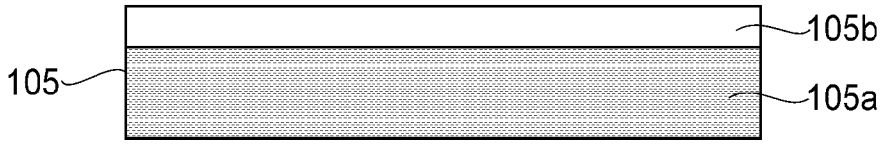
FIG. 4 is a schematic sectional view showing an external heating belt in First Embodiment.

The external heating belt 105 includes, as shown in FIG. 4, a metal base material 105*a* of 60 mm in outer diameter, 50 μm in thickness and 350 mm in length. The base material 105*a* is coated, in order to prevent deposition of the toner, with a 20 μm-thick heat-resistant sliding layer 105*b* of fluorine-containing resin (PFA tube in this embodiment).

Figure 5:
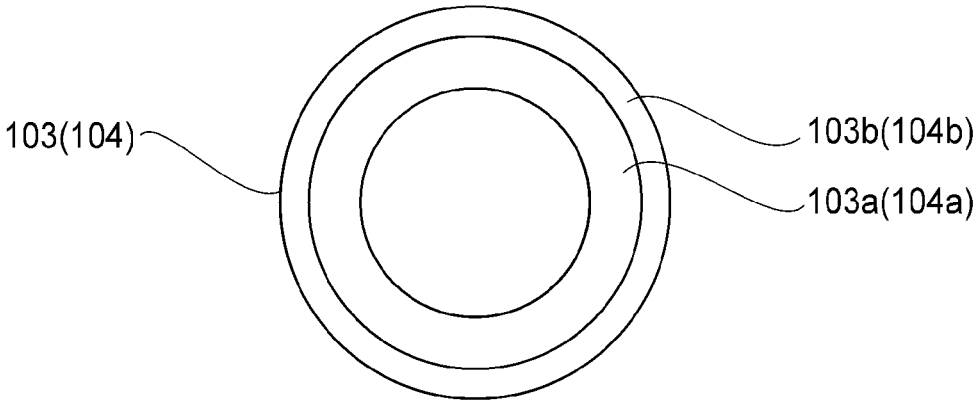
FIG. 5 is a schematic sectional view showing a supporting roller in First Embodiment.

The first supporting roller 103 for stretching the external heating belt 105 is disposed at an upstream side with respect to the rotational direction of the fixing roller 101. That is the first supporting roller 103 is located at the upstream side of the external nip Ne, which is a contact portion of the external heating belt 105 to the fixing roller 101, with respect to the rotational direction of the fixing roller 101. Further, the first supporting roller 103 includes, as shown in FIG. 5, a cylindrical metal core 103*a* (of aluminum in this embodiment) of 30 mm in outer diameter, 3 mm in thickness and 350 mm in length. The metal core 103*a* is coated, in order to prevent abrasion (wearing) thereof with the inner surface of the external heating belt 105, with a 20 μm-thick heat-resistant sliding layer 103*b* of fluorine-containing resin (PFA tube in this embodiment).

(Heating of External Heating Belt)

Inside the metal core 103*a* of the first supporting roller 103, as the heat generating element, a halogen heater 113 as a first heating means for generating heat by energization of rated power of, e.g., 1000 W is disposed to internally heat the external heating belt 105 so that the surface temperature of the external heating belt 105 is a predetermined temperature. The surface temperature of the external heating belt 105 is detected by an upstream side thermistor 123 contacting a contact area D1 between the first supporting roller 103 and the external heating belt 105. Then, on the basis of the detected temperature, the heat control means 160 turns on and off the halogen heater 113 to control (temperature-adjust) the fixing roller surface temperature at a first target temperature T1 of, e.g., 230° C. That is, the heat control means 160 effects heat generating element control as heating control of the supporting roller.

The second supporting roller 104 for stretching the external heating belt 105 has the substantially same constitution as that of the first supporting roller 103 and is disposed at a downstream side with respect to the rotational direction of the fixing roller 101. The second supporting roller 104 also contacts the inner surface of the external heating belt 105 to heat the external heating belt 105. Therefore, an area of the external heating belt 105 passing through the external heating nip Ne is first heated by the second supporting roller 104 and then heated by the first supporting roller 103. Further, the second supporting roller 104 includes, as shown in FIG. 5, a cylindrical metal core 104*a* (of aluminum in this embodiment) of 30 mm in outer diameter, 3 mm in thickness and 350 mm in length. The metal core 103*a* is coated, in order to prevent abrasion (wearing) thereof with the inner surface of the external heating belt 105, with a 20 μm-thick heat-resistant sliding layer 103*b* of fluorine-containing resin (PFA tube in this embodiment).

Referring again to FIG. 1, inside the metal core 104*a* of the second supporting roller 104, as the heat generating element, for generating heat by energization, a halogen heater 114 as a second heating means of rated power of, e.g., 1000 W is disposed. As a result, the external heating belt 105 is internally heated so that the surface temperature of the external heating belt 105 is a predetermined temperature. The surface temperature of the external heating belt 105 is detected by a downstream side thermistor 124 contacting a contact area D2 between the second supporting roller 104 and the external heating belt 105. Then, on the basis of the detected temperature, the heat control means 160 turns on and off the halogen heater 114 to control (temperature-adjust) the fixing roller surface temperature at a second target temperature T2 of, e.g., 230° C.

(Press-Contact and Separation of Fixing Roller, Pressing Roller and Supporting Roller)

Next, the press-contact and separation control of each roller in this embodiment will be described. During the stand-by state, in order to prevent deformation or distortion of the elastic layer 101*b* of the fixing roller 101 and the elastic layer 102*b* of the pressing roller 102, members including the pressing roller 102, the first supporting roller 103 and the second supporting roller 104 are separated from the fixing roller 101 by an unshown separating means. On the other hand, during the printing, i.e., during a fixing (heating) operation of the image on the recording paper, the members including the pressing roller 102, the first supporting roller 103 and the second supporting roller 104 are press-contacted to the fixing roller 101 by an unshown pressing means.

Incidentally, in the case where each of the rollers is kept in press-contact with the fixing roller 101 without being separated from the fixing roller 101 during the stand-by state, the deformation or distortion of the elastic layers in the fixing nip N1 and the external heating nip Ne remains also during the printing, so that a lateral stripe or glossy stripe (uneven glossiness) or the like is generated on the image to lower the image quality. For that reason, as in this embodiment, each of the rollers may preferably be separated during the stand-by state.

(Target temperatures T1 and T2 in upstream side and downstream-side contact areas of external heating belt)

The target temperatures T1 and T2 in the contact areas D1 and D2 will be described. In the following, a description will be provided by showing Comparative Embodiments 1 and 2 in which the target temperatures T1 and T2 are different from those in this embodiment.

Figure 6:
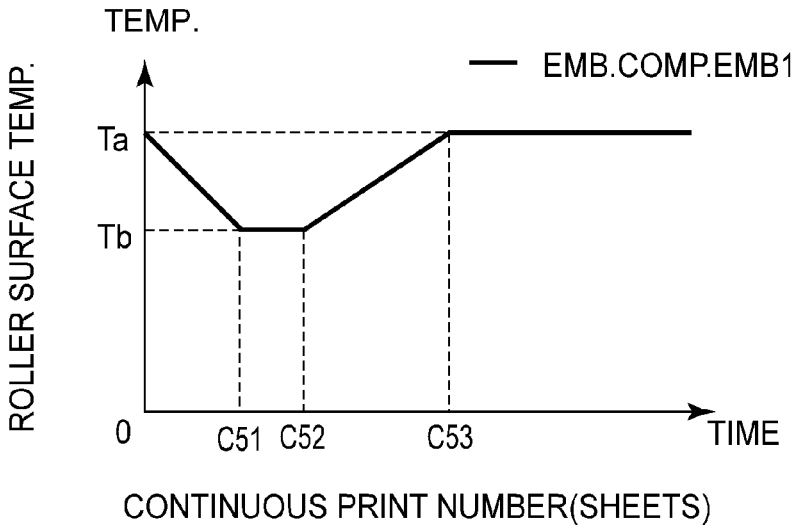
FIG. 6 is a graph showing a change in surface temperature of a fixing roller detected by a thermistor during continuous sheet passing in Embodiment 1 and Comparative Embodiment 1.
Figure 7:
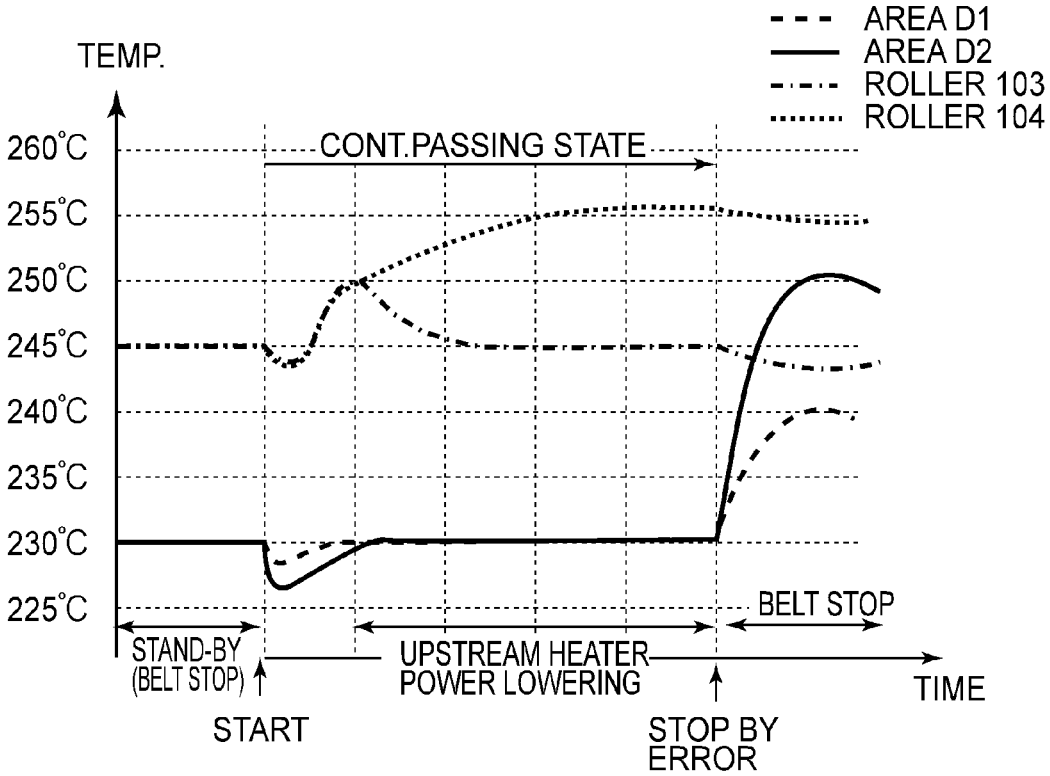
FIG. 7 is a graph showing temperature changes in contact areas D1 and D2 on an external heating belt 105 and of supporting rollers 103 and 104 in Comparative Embodiment 1.
Figure 8:
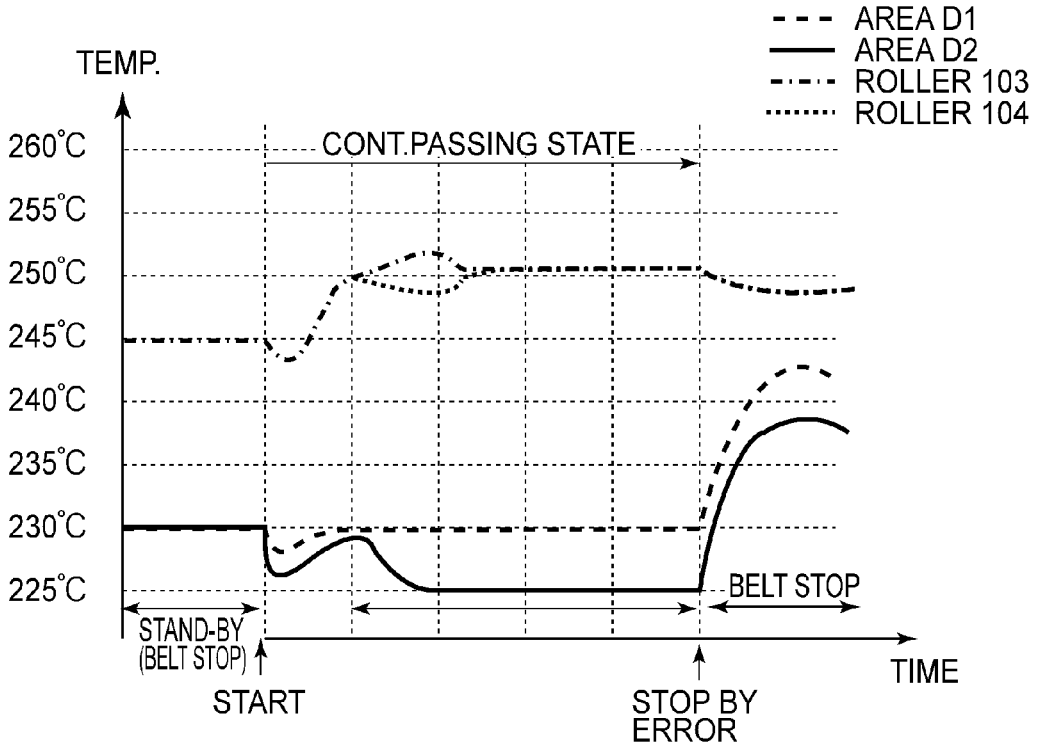
FIG. 8 is a graph showing temperature changes in contact areas D1 and D2 on an external heating belt 105 and of supporting rollers 103 and 104 in Embodiment 1.

FIG. 6 is a graph showing a change in surface temperature of the fixing roller 101 detected by the thermistor 121 during continuous sheet passing in this embodiment and Comparative Embodiment 1. FIGS. 7 and 8 are graphs, in Comparative Embodiment 1 and this embodiment, respectively, each showing a temperature change in the case where the sheet passing is started from the stand-by state and then an error occurs on a 500-th sheet to cause emergency stop.

Here, as the recording paper, sheets of A4-sized paper having a basis weight of 300 g/m$^2$ were continuously passed in a landscape direction at a speed of 100 ppm (pages per minute).

(Comparative Embodiment 1)

First, as Comparative Embodiment 1, the case where the fixing roller temperature falls within a tolerable range but on the other hand, the external heating-belt temperature is cut of a tolerable range when the heating target temperature T1 is 230° C. and the heating target temperature is 230° C. over a whole period including the start of sheet passing and during the sheet passing will be described.

FIG. 6 is a graph showing a temperature change of the fixing roller 101 after start of the printing in Comparative Embodiment 1. The temperature of the fixing roller 101 adjusted at a surface temperature Ta during the stand-by state is lowered when the printing is started and the recording paper reaches the fixing nip N, and reaches a lowest temperature Tb at a print number of C51. This is because the heat is blocked by the metal core 101*a* and the elastic layer 101*b* having low thermal conductivity even when the halogen heater 111 is turned on in order to keep the surface temperature of the fixing roller 101 at the temperature Ta and thus the surface-temperature rise of the fixing roller 101 is delayed. Further, from the start of the sheet passing to a print (sheet passing) number of C51, all the halogen heaters 111 (fixing heater), 112 (pressing heater), 113 and 114 were turned on. Then, when the print number exceeded C52, the temperature of the fixing roller 101 was increased from the lowest temperature Tb to reach the temperature Ta at a print number C53, so that the fixing roller 101 was in a steady state (equilibrium state).

In Comparative Embodiment 1, Ta=200° C. and Tb 32 180° C. are set. Here, the temperature Tb=180° C. of the fixing roller 101 is the lower limit of the tolerable range in which the fixing property can be satisfied and therefore the fixing property at the lowest temperature Tb falls within the tolerable range.

FIG. 7 is a graph showing the temperature changes in the contact areas D1 and D2 of the external heating belt 105 and of the supporting rollers 103 and 104 in Comparative Embodiment 1.

From the start of sheet passing to the print number (100th sheet) at which the fixing roller temperature is restored, the halogen heaters 113 and 114, which are the heat generating sources of the external heating means, were turned on in the whole period. For that reason, the lowest temperature in the upstream-side contact area D1 was 228° C. Further, the power consumption of each of the upstream-side halogen heater 113 and the downstream-side halogen heater 114 was 1000 W.

Further, when the power-consumption values of the halogen heaters 113 and 114 at the time (steady state) when the temperature of the fixing roller 101 was Ta were compared, the power consumption of the upstream-side halogen heater 113 was 300 W and the power consumption of the downstream-side halogen heater 114 was 900 W. That is, it turned out that the heat generation localized at the downstream side was effected. For this reason, in the steady state, the temperature of the upstream-side supporting roller 103 was 245° C. and the temperature of the downstream-side supporting roller 103 was 256° C.

In this steady state, in the case where the error occurs to cause the emergency stop (at 500-th sheet from the start of sheet passing), due to heat conduction from the supporting rollers, the contact areas D1 and D2 are locally increased in temperature. In Comparative Embodiment 1, the external heating belt 105 was locally increased in temperature until the temperature T1 of the contact area D1 reached 240° C. and until the temperature T2 of the contact area D2 reaches 250° C. A heat-resistant temperature of the external heating belt 105 was 245° C. and therefore in the downstream-side contact area D2, the heat-resistant temperature was out of the tolerable range, so that the external heating belt 105 was broken.

(Embodiment 1)

Next, Embodiment 1 will be described. In this embodiment, compared with the start of sheet passing, the downstream-side target temperature T2 is changed to a lower set value during the sheet passing, so that both of the fixing roller temperature and the external heating belt temperature fall within the tolerable range.

In this embodiment, first, at the time of the start of sheet passing, heating control (operation in first control mode) is executed at the target temperature T1 of 230° C. and the target temperature T2 of 230° C. Then, during the sheet passing, after the temperature T1 of the upstream-side contact area D1 reaches the target temperature T1 of 230° C., heating control (operation in second control mode) in which the downstream-side target temperature T2 is lowered from 230° C. to 225° C. is executed.

FIG. 6 is a graph showing a temperature change of the fixing roller 101 after start of the printing in this embodiment. The temperature of the fixing roller 101 adjusted at a surface temperature Ta during the stand-by state is lowered when the printing is started and the recording paper reaches the fixing nip N, and reaches a lowest temperature Tb at a print number of C51. Further, from the start of the sheet passing to a print (sheet passing) number of C51, all the halogen heaters 111, 112, 113 and 114 were turned on. Then, when the print number exceeded C52, the temperature of the fixing roller 101 was increased from the lowest temperature Tb to reach the temperature Ta at a print number C53, so that the fixing roller 101 was in a steady state (equilibrium state).

In this embodiment, Ta=200° C. and Tb=180° C. are set. Here, the temperature Tb=180° C. of the fixing roller 101 is the lower limit of the tolerable range in which the fixing property can be satisfied and therefore the fixing property at the lowest temperature Tb falls within the tolerable range.

FIG. 8 is a graph showing the temperature changes in the contact areas D1 and D2 of the external heating belt 105 and of the supporting rollers 103 and 104 in this embodiment.

From the start of sheet passing to the print number (100th sheet) at which the fixing roller temperature is restored, the halogen heaters 113 and 114 as the heat generating sources of the external heating means were turned on in the whole period. For that reason, the lowest temperature in the upstream-side contact area D1 was 228° C. Further, the power consumption of each of the upstream-side halogen heater 113 and the downstream-side halogen heater 114 was 1000 W.

Further, when the power-consumption values of the halogen heaters 113 and 114 at the time (steady state) when the temperature of the fixing roller 101 was Ta were compared, the power consumption of each of the upstream-side halogen heater 113 and the downstream-side halogen heater 114 was 600 W, so that it was turned out that the uniform heat generation was effected at both of the upstream side and the downstream side. For this reason, in the steady state, the temperature of the upstream-side supporting roller 103 was 251° C. and the temperature of the downstream-side supporting roller 103 was 251° C., thus being equal to each other.

In this steady state, in the case where the error occurs to cause the emergency stop (at 500-th sheet from the start of sheet passing), due to heat conduction from the supporting rollers, the contact areas D1 and D2 are locally increased in temperature. In this embodiment, the external heating belt 105 was locally increased in temperature until the temperature T1 of the contact area D1 reached 243° C. and until the temperature T2 of the contact area D2 reaches 238° C. A heat-resistant temperature of the external heating belt 105 was 245° C. and therefore in the downstream-side contact area D2, the heat-resistant temperature was within the tolerable range.

(Effect of Embodiment 1 Compared with Effect of Comparative Embodiment 1)

Table 1 shows a result of a comparison of the effects of Comparative Embodiment 1 and Embodiment 1.

TABLE 1

<During start of sheet passing (0 to 100 sheets)>

| EMB. NO. | TT*1 UP | (° C.) DOWN | PC*2 UP | (W) DOWN | LT*3 D1 | (° C.) FR*4 |
|---|---|---|---|---|---|---|
| COMP. EMB. 1 | 230 | 230 | 1000 | 1000 | 228 | 180 |
| EMB. 1 | 230 | 230 | 1000 | 1000 | 228 | 180 |

*1"TT" represents the target temperature (° C.).
*2"PC" represents the power consumption (W).
*3"LT" represents the lowest temperature (° C.).
*4"FR" represents the fixing roller.

<Steady state (400-500 sheets)>

| EMB. NO. | TT*1 UP | (° C.) DOWN | PC*2 UP | (W) DOWN | SRT*3 UP | (° C.) DOWN | BT*4 D1 | (° C.) D2 |
|---|---|---|---|---|---|---|---|---|
| COMP. EMB. 1 | 230 | 230 | 300 | 900 | 245 | 255 | 240 | 250 |
| EMB.1 | 230 | 225 | 600 | 600 | 251 | 251 | 243 | 238 |

*1"TT" represents the target temperature (° C.).
*2"PC" represents the power consumption (W).
*3"SRT" represents the supporting roller temperature (° C.) during sheet passing.
*4"BT" represents the belt temperature (° C.) during emergency stop.

As described above, in this embodiment and Comparative Embodiment 1, during the start of sheet passing, the target temperatures T1 and T2 are set at 230° C. As a result, the temperature of the contact area D1 in the neighborhood of the external heating nip Ne is kept at 228° C. or more, with the result that it is possible to prevent the temperature lowering of the fixing roller at the initial stage of sheet passing so that the fixing roller temperature is lowered to 180° C., which is the lower limit of a fixing property tolerable range, at the maximum.

Further, as in this embodiment, by lowering the downstream-side target temperature (T1=230° C., T2=225° C.) as the target temperature in the steady state, the upstream-side and downstream-side power-consumption values in the steady state can be made equal to each other. As a result, overheating occurring at the downstream side can be prevented. On the other hand, as in Comparative Embodiment 1, when the target temperature in the steady state at each of the upstream side and the downstream side is set at the same value (T1=230° C., T2=230° C.), the downstream side 114 provides localized power consumption of 900 W, thus causing the overheating at the downstream side. That is, in order to prevent the downstream-side overheating, the target temperature may preferably be set at T1=230° C. and T2=225° C. during the start of sheet passing.

From the above, in order to compatibly realize "fixing property at the lowest temperature" and "prevention of overheating occurring at the downstream side ", as in Embodiment 1, the downstream-side target temperature T2 may preferably be lowered in the course of the sheet passing so as to satisfy: "T1>T2". Therefore, the target temperature is set as in Embodiment 1, so that it is possible to provide the fixing device capable of preventing the overheating of the external heating means while maintaining the fixing property.

According to the above-described constitution, compared with the conventional constitution, the amount of downstream-side heat generation is lowered and the amount of upstream-side heat generation is increased, so that the difference in amount of heat generation between the upstream side and the downstream side during the continuous sheet passing can be reduced. For that reason, it is possible to avoid heat generation localized on the downstream side to prevent the overheating of the downstream-side supporting roller.

Further, during the emergency stop such as an occurrence of, e.g., paper jam or an error, it is possible to prevent a phenomenon that the temperature of the external heating belt locally exceeds the heat-resistant temperature due to the heat conduction from the downstream-side supporting roller. Therefore, also in long-term use, the external heating belt can be kept in a good state.

<Second Embodiment>

The constitution of the fixing device in this embodiment is the same as that in First Embodiment and only the heat generating element control as the heating control of the supporting roller is different. In First Embodiment, in order to prevent the downstream-side overheating in the steady state, the downstream-side target temperature is lowered but in this embodiment, an on-duty (on-ratio) of the downstream-side heat generating element is lowered. In the following, the control in this embodiment will be described by being compared with Comparative Embodiment 2 in which on-control of the heat generating element is different.

In Comparative Embodiment 2 and this embodiment (Embodiment 2), the sheet passing is started from the stand-by state and then an error occurs on a 500-th sheet to cause emergency stop is compared.

Here, as the recording paper, sheets of A4-sized paper having a basis weight of 300 $g/m_2$ were continuously passed in a landscape direction at a speed of 100 ppm (pages per minute). In both of this embodiment and Comparative Embodiment 2, the target temperatures of the contact areas D1 and D2 were constant at T1=230° C. and T2=230° C.

(Comparative Embodiment 2)

First, as Comparative Embodiment 2, the case where the on-duty of the halogen heaters 113 and 114 is set at 100% in a whole period including the start of sheet passing and during the sheet passing will be described.

In this case, the temperature changes (detection results of the upstream side thermistors 123 and 124) of the contact areas D1 and D2 and the temperature changes of the supporting rollers 103 and 104 are the same as those in Comparative Embodiment 1. That is, when the power-consumption values of the supporting rollers 103 and 104 in the steady state were compared, the power consumption of the upstream-side supporting roller 103 was 300 W and the power consumption of the downstream-side supporting roller 104 was 900 W, so that it turned out that heat generation localized at the downstream side was effected. For this reason, in the steady state, the temperature of the upstream-side supporting roller 103 was 245° C. and the temperature of the downstream-side supporting roller 103 was 256° C.

In this steady state, in the case where the error occurs to cause the emergency stop (at 500-th sheet from the start of sheet passing), due to heat conduction from the supporting rollers, the contact areas D1 and D2 are locally increased in temperature. In Comparative Embodiment 2, the external heating belt 105 was locally increased in temperature until the temperature T1 of the contact area D1 reached 240° C. and until the temperature T2 of the contact area D2 reaches 250° C. A heat-resistant temperature of the external heating belt 105 was 245° C. and therefore in the downstream-side contact area D2, the heat-resistant temperature was out of the tolerable range, so that the external heating belt 105 was broken.

In Comparative Embodiment 2, when the power-consumption values of the upstream-side halogen heater 113 and the downstream-side halogen heater 114 are compared, the following results are obtained. First, during the start of sheet passing (0-100 sheets), similarly as that shown in Table 1, both of the power-consumption values are 1000 W. Further, in the steady state (400-500 sheets), the power-consumption values of the upstream-side halogen heater 113 and the downstream-side halogen heater 114 are 300 W and 900 W, respectively.

(Embodiment 2)

Next, in Embodiment 2, during the start of sheet passing, the heating control (operation in first control mode) is executed with the on-duty of 100% for each of the halogen heaters 113 and 114. Then, during the sheet passing, after the thermistor T1 of the upstream-side contact area D1 reaches the target temperature T1 of 230° C., the heating control (operation in second control mode) in which the downstream side on-duty is lowered from 100% to 60% is executed. In this embodiment, a charge in on-duty of the halogen heater is, e.g., selected from a relationship, between the ON-duty and a time sharing control parameter, shown in Table 2.

TABLE 2

| ON-DUTY (%) | SUB-HEATER TIME SHARING CONTROL |
|---|---|
| 0 | ALL OFF |
| 20 | 1(SEC)ON + 4(SEC)OFF |
| 25 | 1(SEC)ON + 3(SEC)OFF |
| 33 | 1(SEC)ON + 2(SEC)OFF |
| 40 | 2(SEC)ON + 3(SEC)OFF |
| 50 | 2(SEC)ON + 2(SEC)OFF |
| 60 | 3(SEC)ON + 2(SEC)OFF |
| 66 | 2(SEC)ON + 1(SEC)OFF |
| 75 | 3(SEC)ON + 1(SEC)OFF |
| 80 | 4(SEC)ON + 1(SEC)OFF |
| 100 | ALL ON |

The case where the on-duty of the downstream-side halogen heater 114 is lowered from 100% to 60% will be described as an example.

When the temperature detected by the downstream-side halogen heater 114 for the downstream-side temperature control is lower than the target temperature, the halogen heater 114 is turned on ("ON"). At this time, in the case where the on-duty is 100% ("ALL ON"), when the on-duty is lowered from 100% to 60%, by the time sharing control, the heating control is changed so that an operation in which the halogen heater 114 is turned on for 3 seconds and then is turned off for 2 seconds ("3(SEC)ON+2(SEC)OFF") is repeated.

In this embodiment, when the power-consumption values of the upstream-side halogen heater 113 and the downstream-side halogen heater 114 are compared, the following results are obtained. First, during the start of sheet passing (0-100 sheets), similarly as that shown in Table 1, both of the power-consumption values are 1000 W. Then, during the sheet passing, after the thermistor T1 of the upstream-side contact area D1 reaches the target temperature T1 of 230° C., the heating control (operation in second control mode) in which the downstream side on-duty is lowered from 100% to 60%, so that the power consumption of each of the upstream-side halogen heater 113 and the downstream-side halogen heater 114 is 600 W.

That is, compared with Comparative Embodiment 2, the power consumption of the downstream-side halogen heater 114 is lowered from 900 W to 600 W. Further, in order to control the temperature of the contact area D1 at the target temperature T1=230° C., the power consumption of the upstream-side halogen heater 113 is increased to 600 W. Thus, it was turned out that the upstream side and downstream-side halogen heaters generate heat uniformity. For this reason, in the steady state, the temperature of the upstream-side supporting roller 103 was 251° C. and the temperature of the downstream-side supporting roller 104 was also 251° C., thus being equal to each other.

In this steady state, in the case where the error occurs to cause the emergency stop (at 500-th sheet from the start of sheet passing), due to heat conduction from the supporting rollers, the contact areas D1 and D2 are locally increased in temperature. In this embodiment, the external heating belt 105 was locally increased in temperature until the temperature T1 of the contact area D1 reached 243° C. and until the temperature T2 of the contact area D2 reaches 238° C. A heat-resistant temperature of the external heating belt 105 was 245° C. and therefore in the downstream-side contact area D2, the heat-resistant temperature was within the tolerable range.

(Effect of Embodiment 2 Compared with Effect of Comparative Embodiment 2)

Table 3 shows a result of a comparison of the effects of Comparative Embodiment 2 and Embodiment 2.

TABLE 3

| | <Steady state (400-500 sheets)> | | | | | | | |
|---|---|---|---|---|---|---|---|---|
| EMB. NO. | OD*1 UP | (%) DOWN | PC*2 UP | (W) DOWN | SRT*3 UP | (° C.) DOWN | BT*4 Dl | (° C.) D2 |
| COMP. EMB. 1 | 100 | 100 | 300 | 900 | 245 | 255 | 240 | 250 |
| EMB. 1 | 100 | 60 | 600 | 600 | 251 | 251 | 243 | 238 |

*1"OP" represents the on-duty (%).

*2"PC" represents the power consumption (W).

*3"SRT" represents the supporting roller temperature (° C.) during sheet passing.

*4"BT" represents the belt temperature (° C.) during emergency stop.

In this embodiment, the on-duty of the downstream-side halogen heater 114 causing the overheating is lowered to 60%. As a result, compared with Comparative Embodiment 2, the downstream-side power consumption is decreased and the upstream-side power consumption which is originally low is increased, so that the amounts of upstream side and downstream-side heat generation can be uniformized and thus it is possible to prevent the overheating occurring at the downstream side.

Further, in this embodiment, the on-duty of the downstream-side heat generating element is lowered after the temperature of the contact area D1 in the neighborhood of the entrance of the external heating nip Ne reaches the target temperature T1. For this reason, the external heating belt 105 can be sufficiently heated immediately after the start of sheet passing at maximum power consumption of 2000 W and therefore the temperature lowering of the fixing roller 101 can be suppressed within the fixing tolerable range.

Here, as an alternative constitution, it is assumed that the rated power of the upstream-side halogen heater 113 is 1000 W and the rated power of the downstream-side halogen heater 114 is changed from 1000 W to 600 W. Then, in this case, the maximum power consumption of the external heating means is decreased from 2000 W to 1600 W. For this reason, the external heating belt 105 cannot be sufficiently heated immediately after the start of sheet passing, so that the lowest temperature of the fixing roller 101 is lowered to the temperature which is out of the fixing tolerable range and thus the fixing property cannot be maintained. As described above, by controlling the on-duty as in this embodiment, it is possible to provide a fixing device capable of preventing the overheating of the external heating means while maintaining the fixing property.

(Modified Embodiments)

In the embodiments described above, the downstream-side target temperature T2 is changed and set at a value, during the sheet passing, lower than that during the start of sheet passing, so that both of the fixing roller temperature and the external heating belt temperature fall within the tolerable range. However, the target temperature T2 can also be set at the lower value in a period between during the start of sheet passing and during the sheet passing.

Similarly, the downstream side on-duty may be changed and set at a value, during the sheet passing, lower than that during the start of sheet passing. In addition, the downstream side on-duty can also be set at the lower value in a period between during the start of sheet passing and during the sheet passing.

Further, in the above, First and Second Embodiments are described, it is also possible to employ a constitution which includes the constituents of these embodiments in combination. That is, the on-duty may be lowered while lowering the target heating temperature.

Further, instead of the temperature detection that the belt temperature reaches the heating target temperature T1, the heating control may also be changed on condition that a predetermined time which is regarded as a state corresponding to the state in which the belt temperature reaches the heating target temperature T1*d* is elapsed.

Further, the control mode in the present invention is not limited to those described above. For example, it is also possible to use a control mode in which the pulse number of a heating pulse signal with a constant on-duty is made variable and is decreased when the belt temperature reaches the heating target temperature T1 to reduce a target heating time. Further, it is also possible to employ various modifications such as those in which the above-described operations in the control modes are performed either one or both of during the continuous fixing process and during a single-sheet fixing process.

As described above, according to the present invention, it is possible to prevent the overheating in the downstream-side supporting roller area of the belt-like external heating means contacting the outer surface of the image heating member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 239606/2010 filed Oct. 26, 2010, which is hereby incorporated by reference.

What is claimed is:

1. An image heating device comprising:

a rotatable member;

an opposing member configured to form a nip, between itself and said rotatable member, in which recording paper on which an image is carried is to be nip-conveyed and heated;

external heating means for heating said rotatable member in contact with an outer surface of said rotatable member, wherein said external heating means includes a belt, a first supporting roller configured to stretch the belt at an upstream side of said rotatable member with respect to a rotational direction of said rotatable member, a second supporting roller provided downstream of the first supporting roller, first heating means for heating the first supporting roller so that the temperature of the first supporting roller is a first target temperature, and second heating means for heating the second supporting roller so that the temperature of the second supporting roller is a second target temperature;

heating control means for controlling said external heating means; and an executing portion configured to execute an operation in a control mode in which the second target temperature is set so as to be lower than the first target temperature.

2. A device according to claim 1, wherein said heating control means effects heating control in the operation in the control mode during a continuous fixing process.

3. An image heating device comprising:

a rotatable member;

an opposing member configured to form a nip, between itself and said rotatable member, in which recording paper on which an image is carried is to be nip-conveyed and heated;

external heating means for heating said rotatable member in contact with an outer surface of said rotatable member, wherein said external heating means includes a belt, a first supporting roller configured to stretch the belt at an upstream side of said rotatable member with respect to a rotational direction of said rotatable member, a second supporting roller provided downstream of the first supporting roller, first heating means for heating the first supporting roller so that the temperature of the first supporting roller is a first target temperature, and second heating means for heating the second supporting roller so that the temperature of the second supporting roller is a second target temperature;

heating control means for controlling said external heating means; and an executing portion for executing an operation in a control mode in which an on-duty of the second heating means is set so as to be smaller than that of the first heating means.

4. A device according to claim 3, wherein said heating control means effects heating control in the operation in the control mode during a continuous fixing process.

* * * * *